US010378207B2

(12) United States Patent
Gonda

(10) Patent No.: US 10,378,207 B2
(45) Date of Patent: Aug. 13, 2019

(54) SYSTEMS, DEVICES, AND/OR METHODS FOR CONSTRUCTING TOWERS

(71) Applicant: Les Richard Gonda, Keswick, VA (US)

(72) Inventor: Les Richard Gonda, Keswick, VA (US)

( * ) Notice: Subject to any disclaimer, the term of this patent is extended or adjusted under 35 U.S.C. 154(b) by 0 days.

(21) Appl. No.: 14/686,520

(22) Filed: Apr. 14, 2015

(65) Prior Publication Data

US 2015/0292225 A1 Oct. 15, 2015

Related U.S. Application Data

(60) Provisional application No. 61/979,470, filed on Apr. 14, 2014.

(51) Int. Cl.

| | |
|---|---|
| ***E04C 2/34*** | (2006.01) |
| ***E04H 12/02*** | (2006.01) |
| ***E04H 12/08*** | (2006.01) |
| *E04C 2/00* | (2006.01) |

(52) U.S. Cl.

CPC ..... *E04C 2/34* (2013.01); *E04H 12/02* (2013.01); *E04H 12/08* (2013.01); *E04C 2002/001* (2013.01); *E04C 2002/345* (2013.01); *E04C 2002/3444* (2013.01); *E04C 2002/3455* (2013.01); *E04C 2002/3461* (2013.01); *E04C 2002/3466* (2013.01); *E04C 2002/3472* (2013.01)

(58) Field of Classification Search

CPC ..... E04C 2/46; E04C 2/32; E04C 2/34; E04C 2002/3466; E04C 2002/3472; E04C 2002/345; E04C 2002/3461; E04C 2002/3455; E04C 2002/3444; E04C 2002/001

USPC ..... 52/783.17, 783.18, 783.19

See application file for complete search history.

(56) References Cited

U.S. PATENT DOCUMENTS

| | | | | |
|---|---|---|---|---|
| 787,065 A * | 4/1905 | White | F41H 5/04 109/79 |
| 1,236,829 A * | 8/1917 | Evans | 52/783.17 |
| 1,855,161 A * | 4/1932 | Wyman | D21J 1/16 428/182 |
| 2,039,601 A * | 5/1936 | London | E04B 1/74 428/116 |
| 2,280,647 A * | 4/1942 | Hawes | 52/200 |
| 2,901,590 A * | 8/1959 | Watter et al. | 219/78.12 |
| 3,024,879 A * | 3/1962 | Kandra | 52/783.1 |
| 3,033,734 A * | 5/1962 | Price | 156/305 |

(Continued)

FOREIGN PATENT DOCUMENTS

| | | | |
|---|---|---|---|
| FR | 1217207 A * | 5/1960 | E04H 12/08 |
| JP | WO-9319933 A1 * | 10/1993 | |

(Continued)

*Primary Examiner* — Adriana Figueroa

(74) *Attorney, Agent, or Firm* — Dale Jensen, PLC; Dale Jensen

(57) ABSTRACT

Certain exemplary embodiments can provide a method, which can comprise fabricating a substantially concrete free tower. The tower can comprise a plurality of sandwich panels. The tower can comprise a plurality of segmented sections. The plurality of segmented sections can comprise the plurality of sandwich panels. The tower can be assembled by coupling the plurality of segmented sections.

17 Claims, 5 Drawing Sheets

(56) References Cited

U.S. PATENT DOCUMENTS 3,228,361 A * 1/1966 Ritter ..... F41H 5/04 109/84
3,526,031 A * 9/1970 Truitt ..... B23K 9/0026 228/181
3,534,463 A * 10/1970 Molin ..... B21D 47/00 228/185
3,589,972 A * 6/1971 Greig ..... 428/116
3,768,016 A * 10/1973 Townsend ..... H04B 7/155 182/178.1
3,819,466 A * 6/1974 Winfield et al. ..... 428/175
4,133,158 A * 1/1979 Ting ..... 52/478
4,617,072 A * 10/1986 Merz ..... 156/89.25
4,965,138 A * 10/1990 Gonzalez ..... 428/593
5,360,500 A * 11/1994 Evans et al. ..... 156/74
5,715,644 A * 2/1998 Yasui ..... B21D 26/055 228/157
6,209,273 B1 * 4/2001 Jeffers ..... E04B 2/7448 52/220.7
6,380,909 B1 * 4/2002 Wilkinson et al. ..... 343/890
7,416,775 B2 * 8/2008 Snel ..... B31D 3/002 428/178
7,448,169 B2 * 11/2008 Maliszewski ..... E04H 9/04 52/170
8,650,756 B2 * 2/2014 Wadley et al. ..... 29/897.31
8,713,896 B2 * 5/2014 Willis et al. ..... 52/848
9,249,572 B2 * 2/2016 Neumayr ..... E04C 2/3405
2004/0134162 A1 * 7/2004 Douglas ..... 52/741.1
2004/0197519 A1 * 10/2004 Elzey et al. ..... 428/68
2007/0012168 A1 * 1/2007 Weatherwax ..... 89/36.04
2014/0013695 A1 * 1/2014 Wolynski et al. ..... 52/426

FOREIGN PATENT DOCUMENTS

WO WO 9319933 A1 * 10/1993 ..... B32B 3/12
WO WO 2008143662 A1 * 11/2008 ..... E04C 2/34
WO WO 2013124633 A1 * 8/2013 ..... E04H 9/10

* cited by examiner

1000

4000

SYSTEMS, DEVICES, AND/OR METHODS FOR CONSTRUCTING TOWERS

CROSS-REFERENCES TO RELATED APPLICATIONS

This application claims priority to, and incorporates by reference herein in its entirety, U.S. Provisional Patent Application Ser. No. 61/979,470, filed 14 Apr. 2014.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments comprise a structure, which can comprise a plurality of sandwich panels. Each of the plurality of sandwich panels can comprise at least one corrugated core. Other cores can be used in the sandwich panels; for example pyramidal, honeycomb, metal foam, ribbon panels, and/or any other sort of crushable core can be used in certain embodiments. The sandwich panels can be adapted to resist deformation responsive to an applied external force applied to the sandwich panel. The external force can comprise bullet impacts and/or an explosion in proximity to the sandwich panel.

Figure 1:
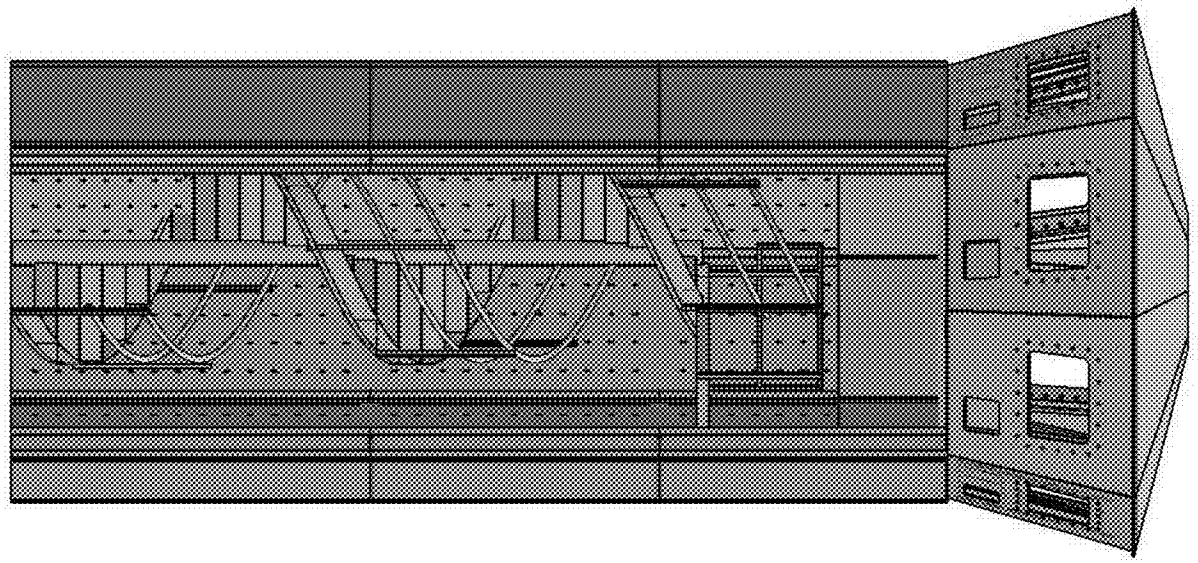
FIG. 1 is a side view of an exemplary embodiment of a system 1000.

FIG. 1 is a side view of an exemplary embodiment of a system 1000, which can comprise a tower. The tower can comprise external panels adapted to shield personnel inside the tower from environmental hazards. For example, the tower can comprise one or more segmented sections, each of which can be fabricated from sandwich panels. One or more of the sandwich panels can be adapted to resist deformation from forces or impacts such as from bullets, projectiles, rockets, explosions, etc. System 1000 can be substantially concrete free. In other embodiments, concrete or any other filler can be added to fill voids to improve structural properties, impact resistance, and/or insulation. In certain exemplary embodiments, system 1000 can be placed upon concrete footers without itself comprising concrete. The illustrated embodiment of system 1000 is octagonal. In other embodiments system 1000 can be substantially round, can have curved surfaces, and/or comprise any number of sides.

In certain exemplary embodiments the tower can be constructed in sections in a fabrication facility. In such embodiments, each of the sections can be transported to an installation site. For example, the sections can be transported via truck, rail car, and/or barge, etc.

The tower can be used in applications such as prison security, military facility security, and/or nuclear power plant security, etc.

A guard can enter the tower via an access door defined by one or more sandwich panels. The guard can traverse up the tower via a staircase enclosed by walls of the tower. The guard can enter a tower view room at the apex of the tower. The view room can comprise a plurality of windows through which the guard can view a surrounding area to monitor and/or report activities and/or events. The plurality of windows can be fabricated of substantially bulletproof materials such as Plexiglas® or any other suitable substantially transparent material that can resist penetration of projectiles and/or resist impacts.

Certain exemplary embodiments can comprise a substantially concrete free tower. The tower can comprise a plurality of sandwich panels and can be assembled via a plurality of segmented sections. The plurality of segmented sections can comprise the plurality of sandwich panels. The tower can be assembled by coupling the plurality of segmented sections. Each of the plurality of sandwich panels can comprise:

- a pair of opposing face sheets;
- a first corrugated core;
- a second corrugated core, wherein each of the first corrugated core and the second corrugated core can have substantially planar corrugations running along a length of each core, corrugation peaks of the first corrugated core fixedly fastened to corresponding corrugation peaks of the second corrugated core;
- at least one corrugated core, wherein the at least one corrugated core can have substantially planar corrugations running along a length of each core;
- an opposing pair of end caps;
- an opposing pair of side caps, wherein each of the opposing pair of end caps and the opposing pair of side caps can be constructed to restrain motion of the first corrugated core and the second corrugated core relative to the pair of opposing face sheets; wherein
- wherein, when an impact or energy is externally applied to either of the opposing pair of face sheets, energy is transferred to the first corrugated core and the second corrugated core, the impact or energy can be from an explosion and/or from a projectile, etc.; and/or
- wherein, when the impact or energy is sufficient to inelastically deform either of the opposing pair of face sheets, the first corrugated core and the second corrugated core will deform and absorb the impact or energy without failing catastrophically or exposing an internal area shielded by the tower, etc.

In some embodiments, the plurality of segmented sections can be separately transported to an installation site. In other embodiments, each of the plurality of segmented sections can be fabricated at an installation site. In some embodiments, each of the plurality of segmented sections can be prefabricated and assembled into a structure prior to delivery at an installation site. The plurality of segmented sections can comprise a base section, at least one intermediate section, and an apex section.

Figure 2:
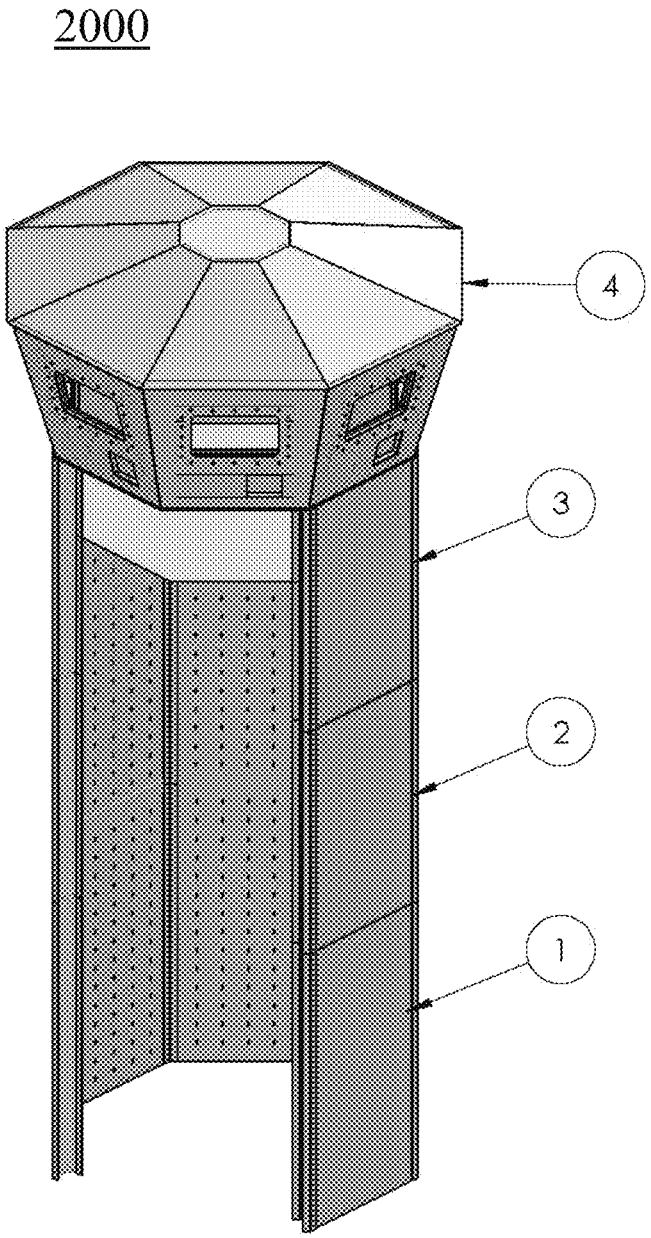
FIG. 2 is a perspective view of an exemplary embodiment of a system 2000.

FIG. 2 is a perspective view of an exemplary embodiment of a system 2000, which can comprise a base 1. Base 1 can comprise a plurality of sandwich panels, such as the sandwich panels of FIG. 3 and FIG. 4. Base 1 can be fabricated on site and/or can be prefabricated and transported to the site. System 2000 can comprise and intermediate section 2, which can also comprise a plurality of sandwich panels, such as the sandwich panels of FIG. 3 and FIG. 4. In certain exemplary embodiments, intermediate section 2 can be substantially similar to base 1 in structure. In other embodiments, base 1 can have increased impact and/or explosion resistance as compared to intermediate section 2.

Figure 3:
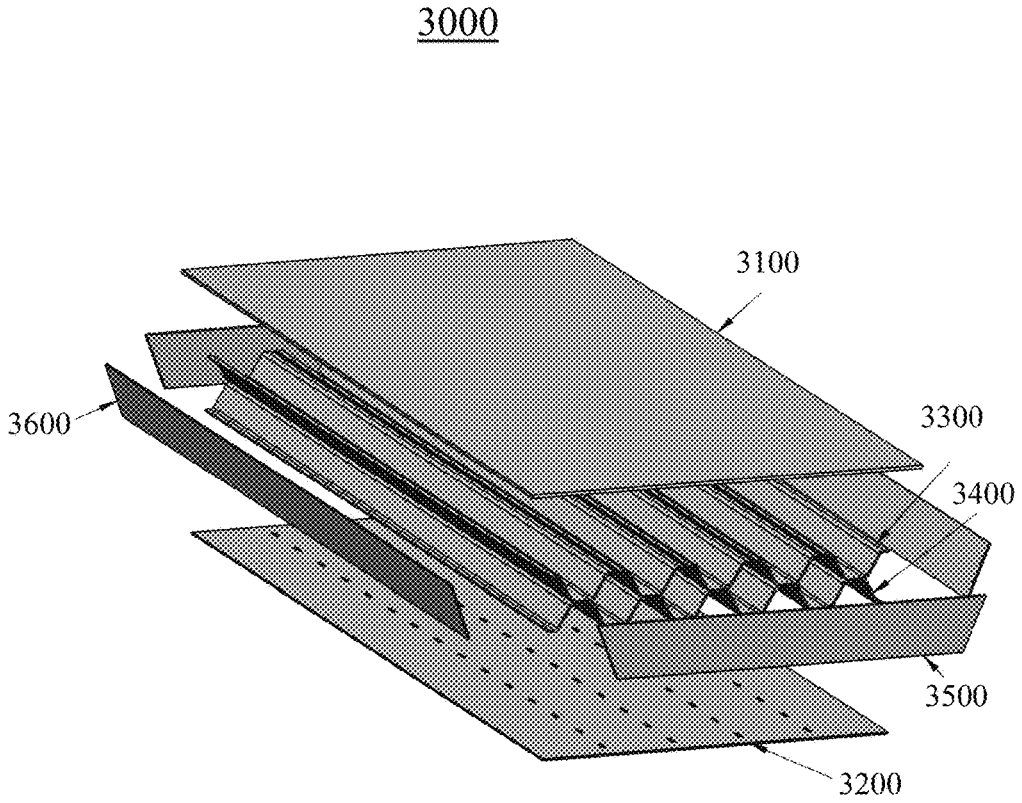
FIG. 3 is an exploded perspective view of an exemplary embodiment of a panel 3000.
Figure 4:
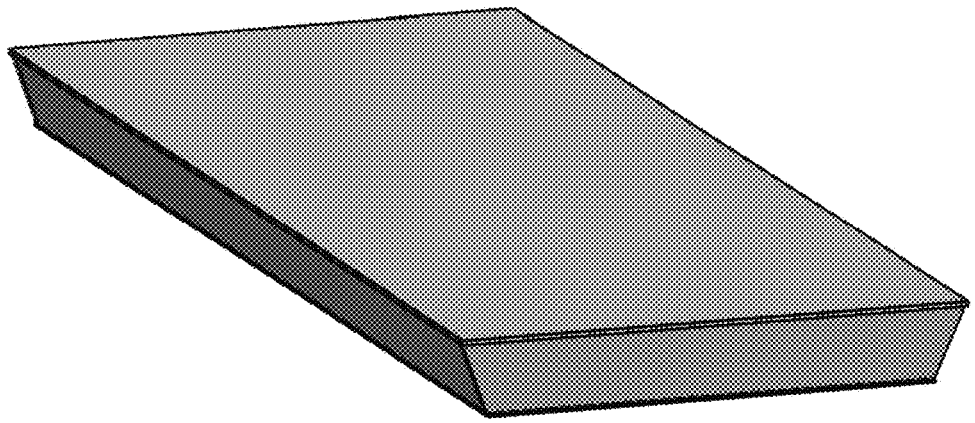
FIG. 4 is a perspective view of an exemplary embodiment of a panel 4000.

System 2000 can comprise and intermediate section 3, which can also comprise a plurality of sandwich panels, such as the sandwich panels of FIG. 3 and FIG. 4. In certain exemplary embodiments, intermediate section 3 can be substantially similar to base 3 in structure. In other embodiments, base 1 can have increased impact and/or explosion resistance as compared to intermediate section 3.

System 2000 can comprise an apex section 4, which can also comprise a plurality of sandwich panels, such as the sandwich panels of FIG. 3 and FIG. 4. Any sandwich panels comprised by apex section 4 can be adapted to resist impact from such externalities as an impacting missile, projectile, bullets, airplane, helicopter, and/or explosive device, etc. Apex section 4 comprises a plurality of view ports allowing personnel in system 2000 to view an area surrounding system 2000.

FIG. 3 is an exploded perspective view of an exemplary embodiment of a panel 3000, which can comprise a pair of opposing face sheets 3100 and 3200. Panel 3000 can comprise a first corrugated core 3300 and/or a second corrugated core 3400. In certain exemplary embodiments, corrugated core 3300 and/or corrugated core 3400 can have substantially rounded corrugations. In other embodiments, corrugated core 3300 and/or corrugated core 3400 can have substantially planar corrugations running along a length of each core. In order to enhance resistance to failure from an impact or externally applied energy, corrugation peaks of corrugated core 3300 can be fixedly fastened to corresponding corrugation peaks of corrugated core 3400. Panel 3000 can comprise an opposing pair of end caps 3500 and/or an opposing pair of side caps 3600. Opposing pair of end caps 3500 and/or an opposing pair of side caps 3600 are adapted to make panel 3000 modular and easily attachable to other panels. Opposing pair of end caps 3500 and/or an opposing pair of side caps 3600 are also adapted to restrain motion of first corrugated core 3300 and/or second corrugated core 3400 relative to face sheets 3100 and 3200.

When an impact or energy is externally applied to either of face sheets 3100 or 3200, energy is transferred to corrugated core 3300 and/or corrugated core 3400. In circumstances where the impact or energy is sufficient to deform either of face sheets 3100 or 3200, corrugated core 3300 and/or corrugated core 3400 will deform and absorb the impact or energy without failing catastrophically or exposing an internal area shielded by panel 3000.

FIG. 4 is a perspective view of an exemplary embodiment of a panel 4000, which illustrates a fully assembled sandwich panel such as the sandwich panel illustrated as panel 3000 of FIG. 3. Panel 4000 can be used in any system or structure for which shielding from energy or impacts are desired. For example, panel 4000 can be used in building walls, boat walls, ship walls, boat decks, ship decks, security towers, building walls, prison walls, prison fences, secured perimeter fencing, and/or vehicle bodies, etc.

Panel 3000 and/or panel 4000 can be used in applications other than guard towers such as those illustrated in system 1000 and/or system 2000. For example, panel 3000 and/or panel 4000 can be used in for walls or other structures for which impact or energy resistance is desired. Panel 3000 and/or panel 4000 can be used in walls that are designed to be resistant to blast impacts and/or impacts from munitions.

The embodiments described herein can be fabricated from any of a variety of suitable materials. For example, the embodiments of system 1000, system 2000, panel 3000, and/or panel 4000 can be fabricated from steel, stainless steel, steel alloys, aluminum, aluminum alloys, metal, metal alloys, polymer materials, metal composites, reinforced plastics such as fiber-reinforced polymers, composites, composites comprising metals, composites comprising reinforced plastics, ceramic, and/or composites comprising ceramic, etc.

Figure 5:
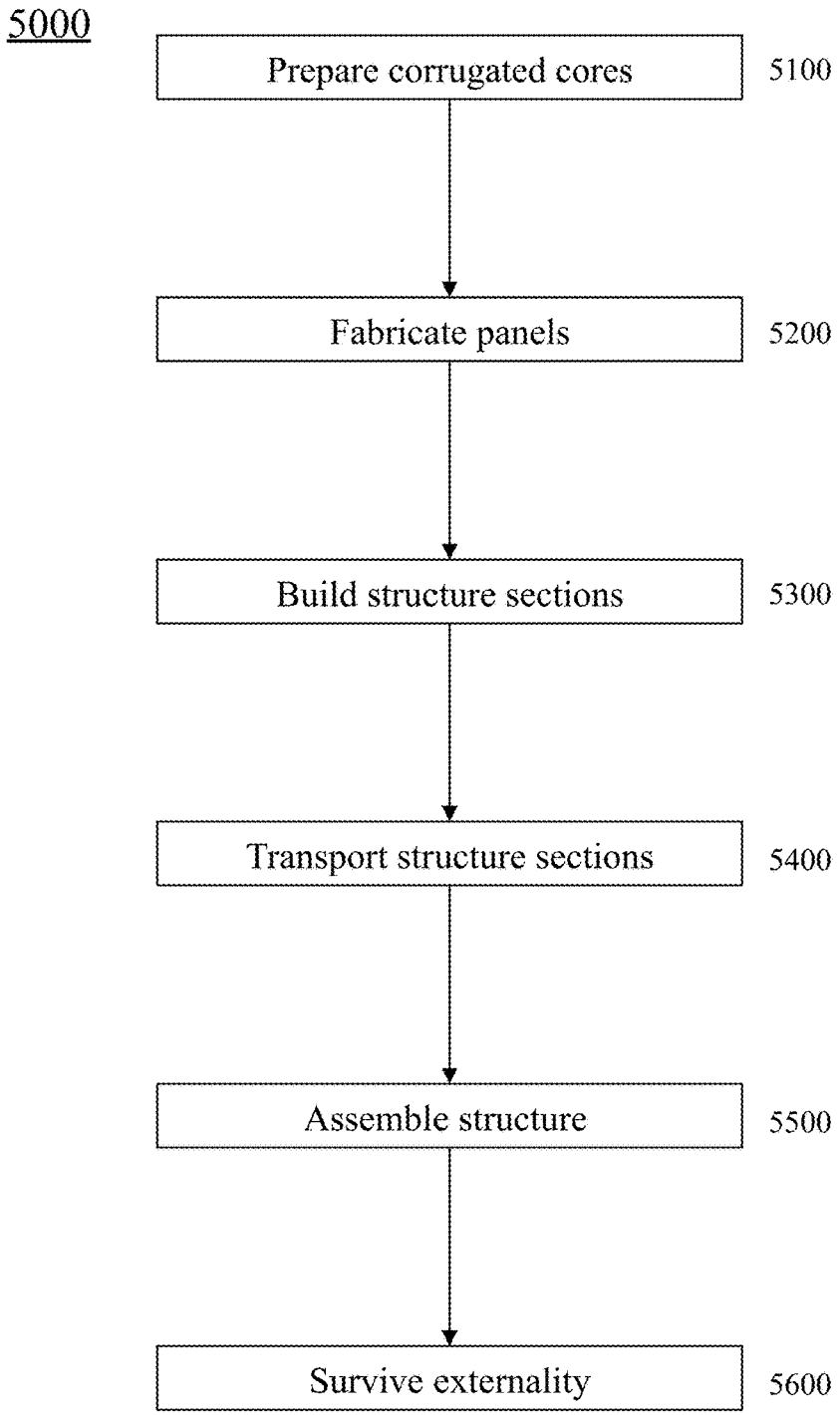
FIG. 5 is a flowchart of an exemplary embodiment of a method 5000.

FIG. 5 is a flowchart of an exemplary embodiment of a method 5000. At activity 5100, corrugated cores can be prepared and/or fabricated for use in a sandwich panel. At activity 5200, panels can be fabricated from a pair of opposing face sheets and one or more corrugated cores. At activity 5300, structure sections (e.g., sections of a security tower) can be built. At activity 5400, structure sections can be transported to a site where the structure is to be assembled.

At activity 5500, the structure can be assembled.

Certain exemplary embodiments comprise fabricating a substantially concrete free tower. The tower can comprise a plurality of sandwich panels. The tower can comprise a plurality of segmented sections. The plurality of segmented sections can comprise the plurality of sandwich panels. The tower can be assembled by coupling the plurality of segmented sections. Each of the plurality of sandwich panels can comprise:

- a pair of opposing face sheets;
- a first corrugated core;
- a second corrugated core, wherein each of the first corrugated core and the second corrugated core can have substantially planar corrugations running along a length of each core, corrugation peaks of the first corrugated core fixedly fastened to corresponding corrugation peaks of the second corrugated core;
- at least one corrugated core, wherein the at least one corrugated core has substantially planar corrugations running along a length of each core;
- an opposing pair of side caps, wherein each of the opposing pair of end caps and the opposing pair of side caps are constructed to restrain motion of the at least one corrugated core relative to the pair of opposing face sheets;
- wherein, when an impact or energy is externally applied to either of the opposing pair of face sheets, energy is transferred to the at least one corrugated core; and
- wherein, when the impact or energy is sufficient to deform either of the opposing pair of face sheets, the at least one corrugated core will deform and absorb the impact or energy without failing catastrophically or exposing an internal area shielded by the tower.

Certain exemplary embodiments comprise transporting the tower in segments to an installation site. Certain exemplary embodiments comprise assembling the tower at an installation site At activity 5600, the structure can survive an application of externalities such as projectile impact and/or an explosion.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.
absorb—to receive and dissipate by physical action.
activity—an action, act, step, and/or process or portion thereof.
adapted to—made suitable or fit for a specific use or situation.
adapter—a device used to effect operative compatibility between different parts of one or more pieces of an apparatus or system.
and/or—either in conjunction with or in alternative to.
apex section—a portion intended to be uppermost in a structure.
apparatus—an appliance or device for a particular purpose.
apply—to place into contact.
assemble—to put together.
base section—a portion intended to be lowermost in a structure.
can—is capable of, in at least some embodiments.
comprising—including but not limited to.
concrete free—substantially without any cement based stonelike material.
connect—to join or fasten together.
constructed to—made suitable or fit for a specific use or situation.
corrugated core—an internal portion of a sandwich panel that comprises alternate furrows and ridges.
corrugation—a furrow and a ridge.
couple—to link in some fashion.
coupleable—capable of being joined, connected, and/or linked together.
define—to establish the outline, form, or structure of.
deform—to inelastically change the shape of something.
device—a machine, manufacture, and/or collection thereof
end cap—a plate that covers an end of a sandwich panel.
energy—a capacity of a physical system to do work.
explosion—a release of energy resulting from a rapid chemical that produces a shock wave, loud noise, heat, and/or light.
expose—to be open to danger, attack, and/or harm.
externally—of or relating to the outer part of something.
fabricate—to construct.
face sheet—a plate that covers a sandwich panel in a plane having the largest two dimensions of the sandwich panel.
fail catastrophically—to break, be destroyed, or made useless because of a sudden event.
fixedly—fastened, attached, or placed so as to be firm and substantially not nondestructively removable.
impact—a forceful contact of one thing against another.
inelastically—incapable of returning to an original shape after being deformed.
install—to connect or set in position and prepare for use.
installation site—a place where a tower is erected for use.
intermediate section—a portion of a tower intended to be between a base section and an apex section of a tower.
internal area—a portion of a tower that is shielded by a plurality of sandwich panels.
may—is allowed and/or permitted to, in at least some embodiments.
method—a process, procedure, and/or collection of related activities for accomplishing something.
motion—an action of changing from one place to another.
opposing—placing in a manner that is opposite or facing.
peak—a highest level of a corrugation ridge.
planar—substantially flat.
plurality—the state of being plural and/or more than one.
predetermined—established in advance.
projectile—an object fired from a gun with an explosive propelling charge, such as a bullet, shell, rocket, or grenade.
relative—something standing in connection to something else.
restrain—to limit by a physical interaction.
sandwich panel—a cellular structure that comprises opposing face sheets and a core coupled between the opposing face sheets, wherein the core defines void spaces and is not solid.
segmented section—a discretely fabricated portion of a tower that is cut off by an intersecting plane from other segmented sections.
separately—as a discrete part.
shield—to resist, reduce, and/or prevent damage.
side cap—a plate that covers a side of a sandwich panel.
substantially—to a great extent or degree.
sufficient—adequate for a purpose.
support—to bear the weight of, especially from below.
system—a collection of mechanisms, devices, machines, articles of manufacture, processes, data, and/or instructions, the collection designed to perform one or more specific functions.
tower—a building or structure that is high in proportion to its lateral dimensions.
transfer—to change from one thing to another.
transport—to convey from on location to another.
via—by way of and/or utilizing.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

no characteristic, function, activity, or element is "essential";

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A system comprising:

a substantially concrete free tower, said tower comprising a staircase enclosed by walls of said tower, said tower comprises a tower view room in an apex section of said tower, said tower view room comprising a plurality of windows, said tower view room tapered such that a top edge of each of said plurality of windows is further away from a center of said tower than a bottom edge of each of said plurality of windows so as to allow personnel in said tower view room to view a base of said tower, said plurality of windows placed to provide a view in substantially all directions around said tower, said tower comprising a plurality of sandwich panels, said tower comprises a plurality of segmented sections, said plurality of segmented sections comprising said plurality of sandwich panels, said tower assembled by coupling said plurality of segmented sections, each of said plurality of sandwich panels comprising:

a pair of opposing face sheets;

a first corrugated core;

a second corrugated core, each of said first corrugated core and said second corrugated core having substantially planar corrugations running along a length of each core, corrugation peaks of said first corrugated core fixedly fastened to corresponding corrugation peaks of said second corrugated core;

an opposing pair of end caps, a longitudinal axis of each of said opposing pair of end caps substantially perpendicular to said substantially planar corrugations running along said length of each core, each of said opposing pair of end caps having a cross-section of an isosceles trapezoid that does not comprise any right angles; and an opposing pair of side caps, each of said opposing pair of end caps and said opposing pair of side caps constructed to restrain motion of said first corrugated core and said second corrugated core relative to said pair of opposing face sheets; wherein when an impact or energy is externally applied to either of said opposing pair of face sheets, energy is transferred to said first corrugated core and said second corrugated core; and wherein, when said impact or energy is sufficient to inelastically deform either of said opposing pair of face sheets, said first corrugated core and said second corrugated core will deform and absorb said impact or energy without failing catastrophically or exposing an internal area shielded by said tower.

2. The system of claim 1, wherein:

each of said plurality of segmented sections is separately transported to an installation site.

3. The system of claim 1, wherein:

each of said plurality of segmented sections is fabricated at an installation site.

4. The system of claim 1, wherein:

each of said plurality of segmented sections is prefabricated and assembled into a structure prior to delivery at an installation site.

5. The system of claim 1, wherein:

said plurality of segmented sections comprises a base section, at least one intermediate section, and an apex section.

6. The system of claim 1, wherein:

said impact or energy is from an explosion.

7. The system of claim 1, wherein:

said impact or energy is from a projectile.

8. The system of claim 1, further comprising:

an access door defined by one or more of said plurality of sandwich panels, said door providing access to personnel to an inside of said tower.

9. The system of claim 1, wherein:

each of said plurality of windows is substantially uniformly distributed around said apex section.

10. The system of claim 1, wherein:

each of said plurality of windows is fabricated of substantially bulletproof materials.

11. The system of claim 1, wherein:

said tower shields personnel inside said tower from environmental hazards.

12. The system of claim 1, wherein:

said staircase is a spiral staircase.

13. The system of claim 1, wherein:

said tower comprises eight sides and has a sectional profile that is substantially that of an octagon.

14. The system of claim 1, wherein:

said opposing face sheets are substantially planar and substantially parallel to each other.

15. A method comprising a plurality of activities, comprising:

fabricating a substantially concrete free tower, said tower comprising a staircase enclosed by walls of said tower, said tower comprises a tower view room in an apex section of said tower, said view room comprising a plurality of windows, said tower view room tapered such that a top edge of each of said plurality of windows is further away from a center of said tower that a bottom edge of each of said plurality of windows so as to allow personnel in said tower view room to view a base of said tower, the plurality of windows placed to provide a view in substantially all directions around said tower, said tower comprising a plurality of sandwich panels, said tower comprises a plurality of segmented sections, said plurality of segmented sections comprising said plurality of sandwich panels, said tower assembled by coupling said plurality of segmented sections, each of said plurality of sandwich panels comprising:

a pair of opposing face sheets;

at least one corrugated core, said at least one corrugated core having substantially planar corrugations running along a length of each core; and an opposing pair of end caps, a longitudinal axis of each of said opposing pair of end caps substantially perpendicular to said substantially planar corrugations running along said length of each core, each of said opposing pair of end caps having a cross-section of an isosceles trapezoid that does not comprise any right angles; and an opposing pair of side caps, each of said opposing pair of end caps and said opposing pair of side caps constructed to restrain motion of said at least one corrugated core relative to said pair of opposing face sheets; wherein wherein, when an impact or energy is externally applied to either of said opposing pair of face sheets, energy is transferred to said at least one corrugated core; and wherein, when said impact or energy is sufficient to deform either of said opposing pair of face sheets, said at least one corrugated core will deform and absorb said impact or energy without failing catastrophically or exposing an internal area shielded by said tower.

16. The method of claim 15, further comprising:

transporting said tower in segments to an installation site.

17. The method of claim 15, wherein:

assembling said tower at an installation site.

* * * * *